United States Patent [19]

Iijima et al.

[11] Patent Number: 4,490,459

[45] Date of Patent: Dec. 25, 1984

[54] MULTI-LAYERED COLOR PHOTO-SENSITIVE MATERIAL

[75] Inventors: Toshifumi Iijima, Hino; Kaoru Onodera, Odawara; Wataru Fujimatsu, Hino, all of Japan

[73] Assignee: Konishiroku Photo Industry Co., Ltd., Tokyo, Japan

[21] Appl. No.: 493,770

[22] Filed: May 12, 1983

Related U.S. Application Data

[63] Continuation of Ser. No. 306,686, Sep. 29, 1981, abandoned.

[30] Foreign Application Priority Data

Oct. 3, 1980 [JP] Japan ..... 55-138402

[51] Int. Cl.[3] ..... G03C 1/46

[52] U.S. Cl. ..... 430/505; 430/504; 430/544; 430/957

[58] Field of Search ..... 430/502, 503, 504, 505, 430/544, 957

[56] References Cited

U.S. PATENT DOCUMENTS

| | | | |
|---|---|---|---|
| 4,248,962 | 2/1981 | Lau | 430/553 |
| 4,315,070 | 2/1982 | Ranz et al. | 430/505 |
| 4,320,193 | 3/1982 | Robillard | 430/503 |
| 4,387,159 | 6/1983 | Engelmann et al. | 430/544 |

*Primary Examiner*—J. Travis Brown

*Attorney, Agent, or Firm*—Jordan B. Bierman

[57] ABSTRACT

The invention relates to multi-layered color photosensitive materials having a support, a red photosensitive silver halide emulsion layer containing a non-diffusible cyan coupler, a green photosensitive silver halide emulsion layer containing a non-diffusible yellow coupler and a blue photosensitive silver halide emulsion layer containing a non-diffusible magenta coupler coated on a support in the order recited and wherein the green photosensitive emulsion layer contains a compound capable of reacting with an oxidized color developing agent to release a development inhibiting substance.

6 Claims, No Drawings

MULTI-LAYERED COLOR PHOTO-SENSITIVE MATERIAL

This application is a continuation application of Ser. No. 306,686, filed Sept. 29, 1981, now abandoned, which in turn claims the priority of Japanese patent application No. 138402/1980, filed on Oct. 3, 1980.

The present invention relates to a novel multi-layered color photosensitive material to be used in a negative-positive printing process, and said material contains chemical compounds releasing substances for inhibiting development (hereinafter referred to as the color photosensitive material).

It has so far been known the process that compounds releasing substances for inhibiting development during the development, that is the so-called DIR compounds, are contained in a color photosensitive material. As for said DIR compounds, a variety thereof have been used. Among them, there are given as the examples thereof such as the so-called DIR couplers which react to oxides of a color developing agent and form color dyes and further release substances for inhibiting development during the development; so-called DIR substances which react to oxides of a color developing agent and release substances for inhibiting development, but do not form any color dye during the development; substances which directly release substances for inhibiting development through the reaction thereof to oxides of color developing agent; and substances which indirectly release substances for inhibiting development through the reaction thereof to oxides of color developing agent of which, for example, described in the Japanese Patent Publication Open to Public Inspection No. 145135/1979, (hereinafter referred to as Timing DIR compounds).

In the case that said DIR compounds are used in a color photosensitive material, it is possible to obtain the so-called inter-image effect, that is, an effect that substances for inhibiting development are released from DIR compounds and inhibit to develop other silver halide emulsion layer during the development of the color photosensitive material. It has so far been tried to improve the purity of color, particularly the purity of primary colors, in the case that a subject is color-reproduced onto a photosensitive printing material by utilizing said inter-image effect.

In other words, the improvements of purity of color have been constrived by containing DIR compounds in a color photosensitive material having red-photosensitive silver halide emulsion layer containing nondiffusion cyan coupler, green-photosensitive silver halide emulsion layer containing nondiffusion magenta coupler, and blue-photosensitive silver halide emulsion layer containing nondiffusion yellow couplers in the order, on the support thereof. However, with such ways and means of the above, an inter-image effect is not satisfactory particularly on blue-photosensitive silver halide emulsion layer which is positioned at the farthest place from the support, and the purity of color in blue does not reach the satisfactory degree thereof.

An object of the present invention is to provide a color photosensitive material having an excellent purity of colors, particularly to provide a color photosensitive material remarkably improving the purity of color in blue.

We, the present inventors, have researched and studied energetically, paying attention to the points that, in the case of a natural color image reproduction through a negative-positive printing process, a color photosensitive material is merely a medium, and particularly that it is unnecessary to be in a relation of complementary colors between color-sensitivity of a silver halide emulsion layer and color dyes to be formed in said layer. As the results therefrom, we have recognized the fact that there is a limit to achieve the object mentioned above in the case that the combination of the silver halide emulsion layer and the couplers of the aforesaid conventional type of color photosensitive materials remains kept. Based on the observations as above, a further research and studies have been proceeded in series, and thereby we have found the fact that the objects of the invention can be achieved by making use of the following types of color photosensitive materials.

That is to say, a color photosensitive material of the present invention is a multi-layered color photosensitive material comprising a support, and a red-photosensitive silver halide emulsion layer containing a nondiffusion cyan coupler, a green-photosensitive silver halide emulsion layer containing nondiffusion yellow coupler and a blue-photosensitive silver halide emulsion layer containing a nondiffusion magenta coupler provided in this order on the support, said green-photosensitive silver halide emulsion layer comprising a compound which is capable of releasing a development inhibiting substance by reacting with an oxidized color developing agent.

DIR compound of the invention is classified into the two types thereof, viz., the one, wherein the ingredient which is reactable to oxides of color developing agent, directly connects with the ingredient for inhibiting development, and the other having the ingredients for inhibiting development through timing radicals. Hereupon, the preferable DIR compounds of the latter are formulated in the following general formula (1):

A-TIME-Z — General Formula (1)

Wherein A represents an ingredient which is, upon reaction with an oxidized color developing agent, capable of releasing TIME-Z radical therefrom, Z represents a development inhibiting ingredient, and TIME represent a timing radical which is capable of releasing Z subsequent to releasing of TIME-Z radical from A.

As for the concrete examples of the TIME, it may well use anyone prepared by intramolecular nucleophilic substitution reaction as described in the Japanese Patent Publication Open to Public Inspection No. 145135/1979 or any one prepared by an electron transfer made along a conjugated chain as described in the Japanese patent application No. 17655/1980, and in short, it may as well use any compound in which the coupling of A-TIME is disconnected firstly, TIME-Z radical is released and then the coupling of TIME-Z is disconnected and Z is released therefrom. Z includes the development inhibiting ingredients as described in the Research Disclosure, vol. 176, No. 17643 and published in Dec., 1978 (hereinafter referred to as the Literature 1), and preferably includes mercaptotetrazol, selenotetrazol, mercaptobenzothiazole, selenobenzothiazole, mercaptobenzoxazole, selenobenzoxazole, mercaptobenzimidazole, selenobenzimidazole, benzotriazole, benzodiazol and the derivatives thereof.

The preferable development inhibiting ingredients are the ones shown in the following general formulae:

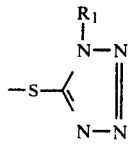

General Formula (a)

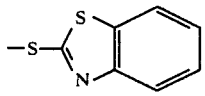

General Formula (b)

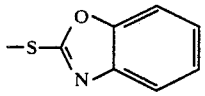

General Formula (c)

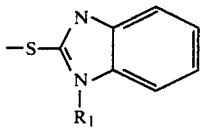

General Formula (d)

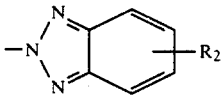

General Formula (e)

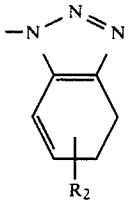

General Formula (f)

In the above formulae, $R_1$ represents hydrogen, alkyl radical having one to eight carbon atoms (e.g., methyl radical, ethyl radical, or butyl radical), phenyl radical, or substituted phenyl radical; and $R_2$ represents hydrogen, one to four halogen (e.g., chlorine, fluorine, or bromine), lower alkyl radical having one to four carbon atoms, or nitro radical.

The compounds formulated in the general formula (1) includes the compounds shown in the following general formulae, (2), (5) and (6), in the concrete: General Formula (2)

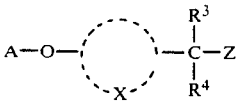

General Formula (2)

In which, A and Z represent the same ingredients as defined respectively in the said general formula (1); the remainders, exclusive of A and Z, correspond to TIME radicals in the general formula (1): X represents benzene ring which may have substituted radicals, or a group of atoms necessary to complete naphthalene ring; $R^3$ and $R^4$ represent hydrogen atom, alkyl radical, or aryl radical, respectively. And, the radical formulated as

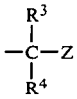

is substituted at ortho-position or para-position to oxygen atom.

The compound shown in the above general formula (2) is cleft when reacted with an oxidized color developing agent, and produces the compound shown in the following general formula (3) first, and successively, the compound (3) is cleft again by electron transfer along a conjugated system and produces compound shown in the following general formula (4), and at the same time releases Z.

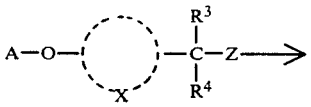

[General Formula (2)]

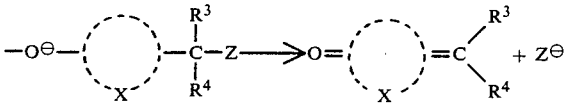

[General Formula (3)] [General Formula (4)]

The compounds shown in the above general formula (4) are the one called as quinone methide or naphthoquinone methide.

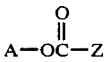

General Formula (5)

Wherein, A and Z represent the same ingredients as defined respectively in the said general formula (1), and the radical formulated as

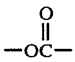

corresponds to the TIME radical in the general formula (1). General Formula (6)

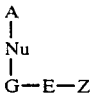

General Formula (6)

Wherein A represents an ingredient being capable of reacting with an oxidized color developing agent, Nu represents oxygen, sulfur or mitrogen atom, G represents a radical capable of stracturally connecting Nu with E, E represents an electrophilic radical comprising carbonyl radical, thiocarbonyl radical, phosphinyl radical or thiophosphinyl radical, and Z represents a development inhibiting ingredient, provided that said -Nu-G-E-Z radical is one capable of causing, subsequent to release from A, intramolecular nucleophilic substitution reaction to form a 3 to 7 membered ring, thereby releasing Z herefrom.

The DIR compounds having ingredients for inhibiting development through the above timing radicals having been described in the Japanese Patent Publication Open to Public Inspection No. 145135/1979, the Japanese patent application No. 17644/1980 and so on.

On the other hand, the preferable DIR compounds wherein ingredients capable of reacting to oxides of color developing agent have directly inhibiting ingredients in themselves, are formulated in the following general formula (7).

A—Z General Formula (7)

Wherein, A and Z represent the same ingredient as defined respectively in the said general formula (1).

The aforesaid DIR compounds wherein the ingredients capable of reacting to oxides of color developing agent have directly inhibiting ingredient in themselves, are given as described in the U.S. Pat. Nos. 3,958,993, 3,961,959, and 3,938,996, and the Japanese Patent Publication Open to Public Inspection Nos. 147716/1975, 152731/1975, 105819/1976, 6724/1976 and 46817/1977, and the U.S. Pat. Nos. 3,928,041, 3,227,554, 3,773,201, and 3,632,345, and the British Patent No. 2,010,818, and the Japanese Patent Publication Open to Public Inspection No. 49030/1977, etc.

Both A represented in the aforesaid general formulae, (1), (5) and (6), and B represented in the general formula (7) include respectively both the one that forms dyes through the reaction thereof to oxides of color developing agent and the other one that does not form any dyes.

Next, the concrete exemplary examples of the DIR compounds shown in the aforesaid general formula (1) are given as follows but it is to be understood that the compounds to be used in the invention are not limited to the specific examples shown herein.

Exemplified compounds:

T-1

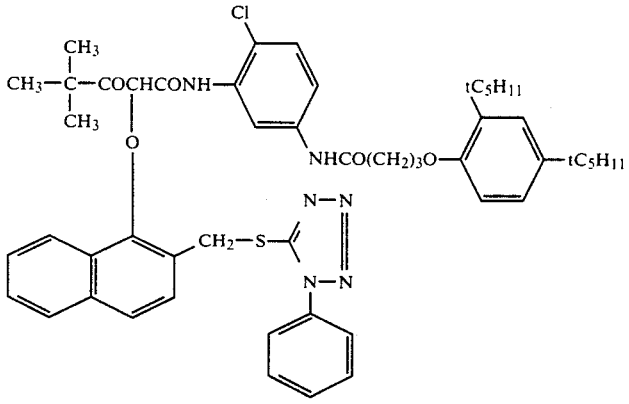

T-2

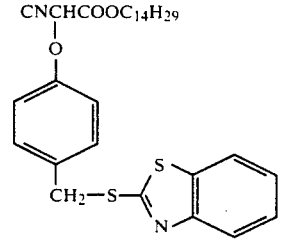

T-3

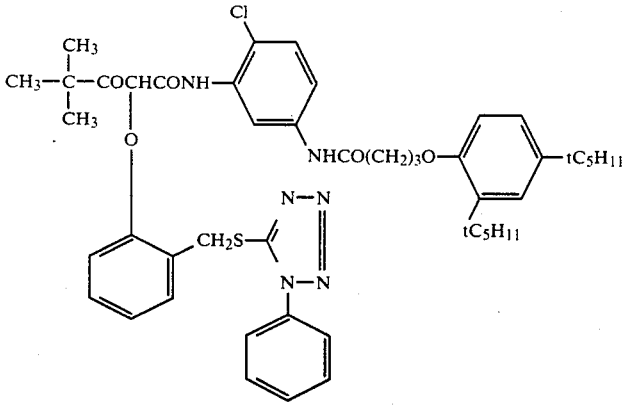

-continued
T-4
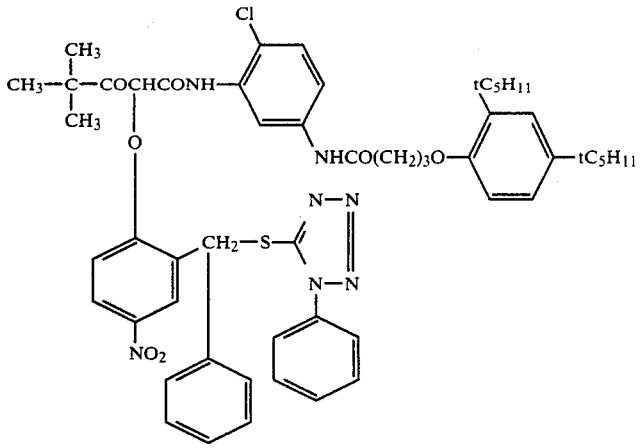
T-5
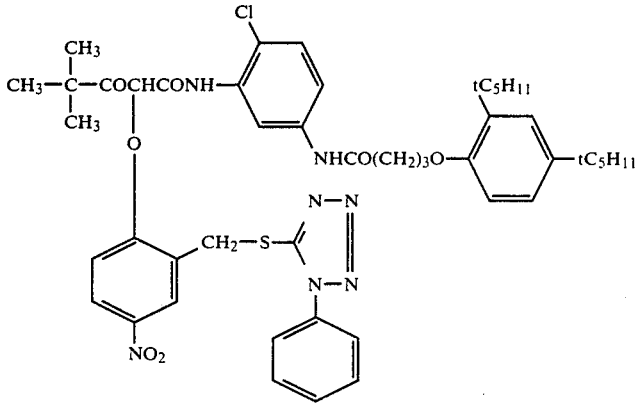
T-6
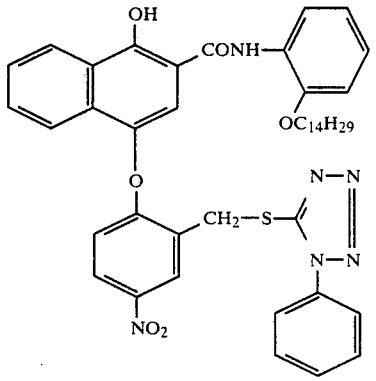
T-7
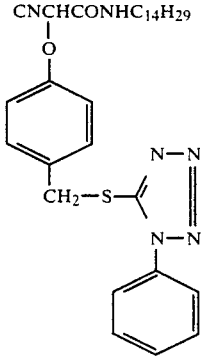
T-8
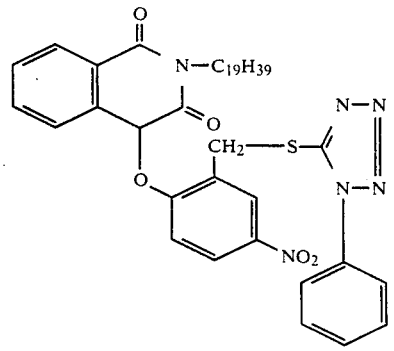
T-9
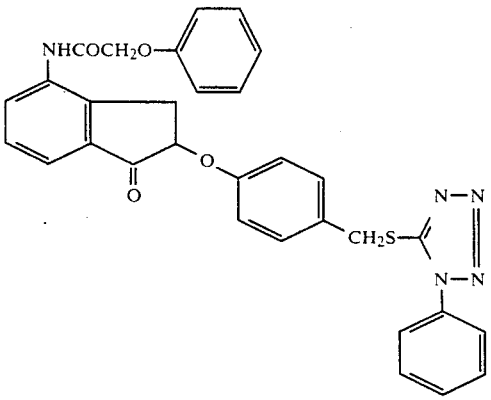

-continued
T-10
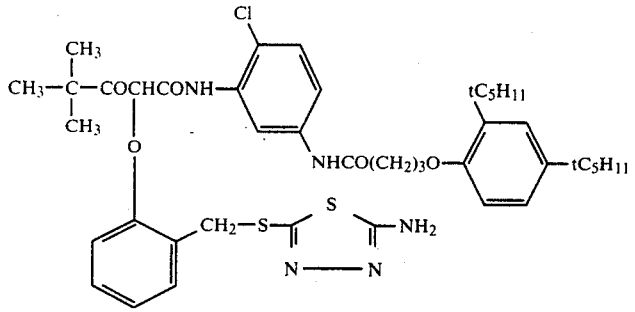
T-11
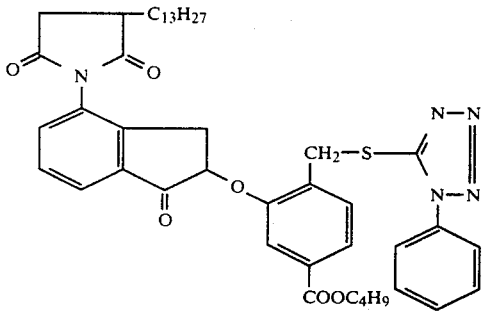
T-12
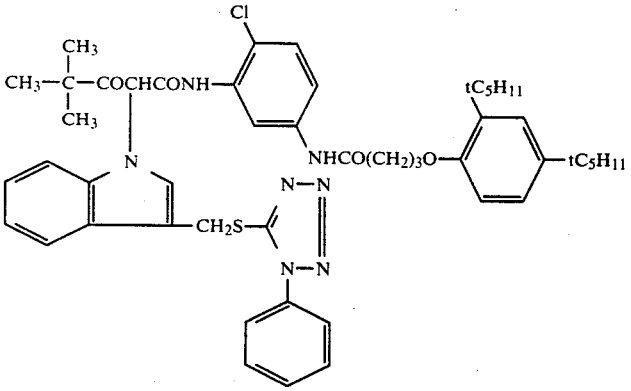
T-13
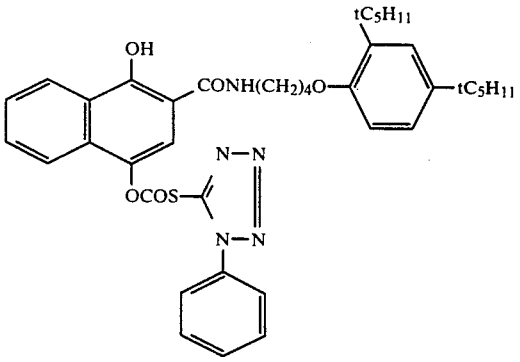

-continued
T-14
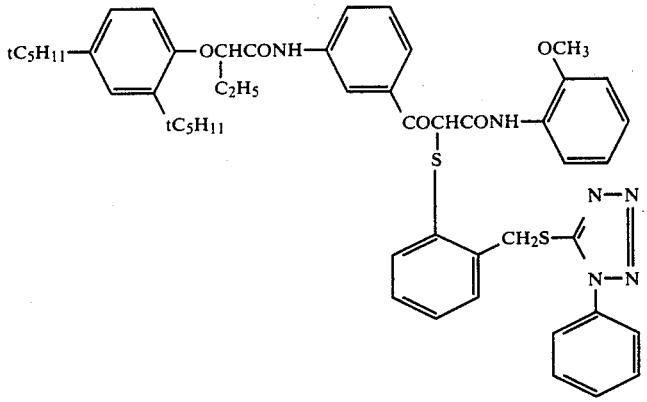
T-15
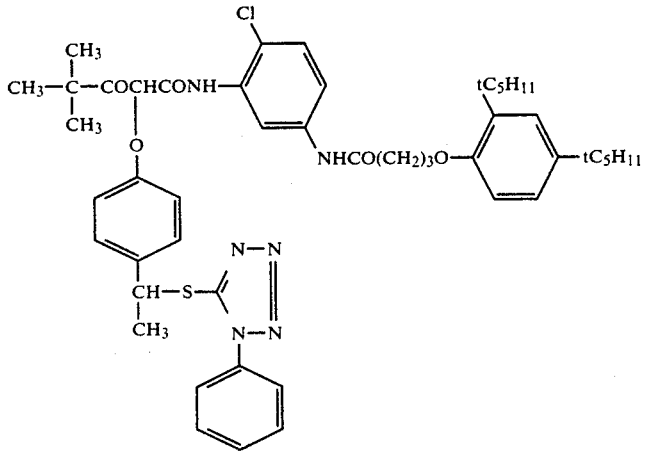
T-16
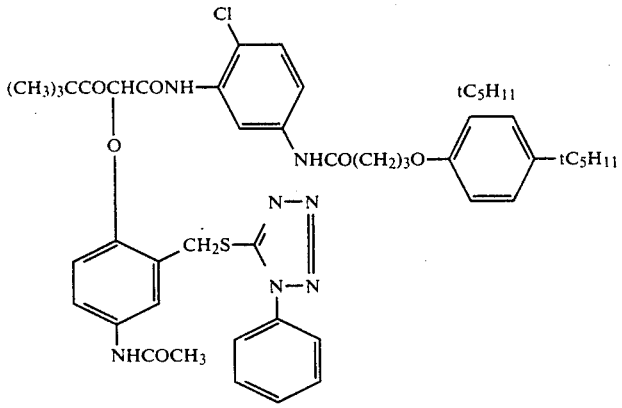
T-17
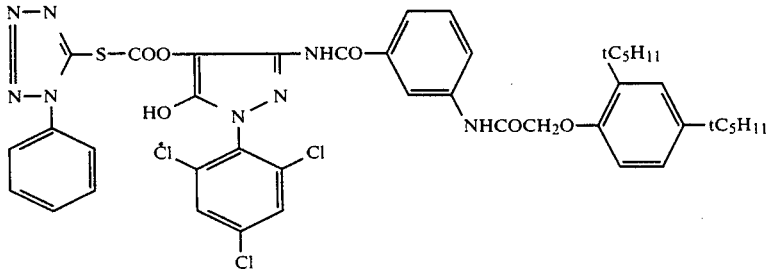

-continued
T-18
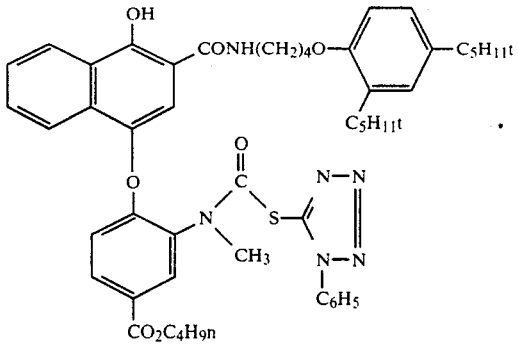
T-19
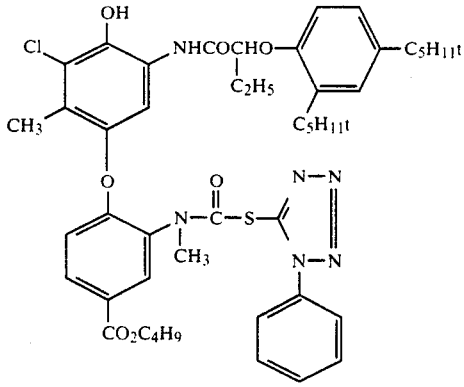
T-20
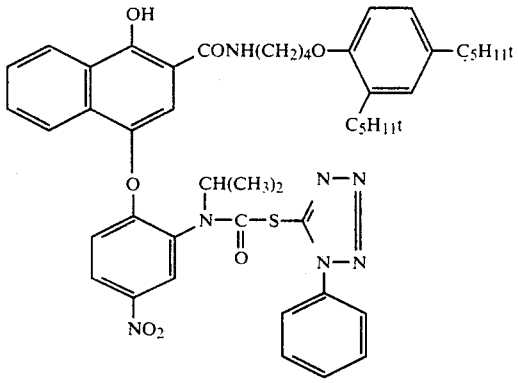
T-21
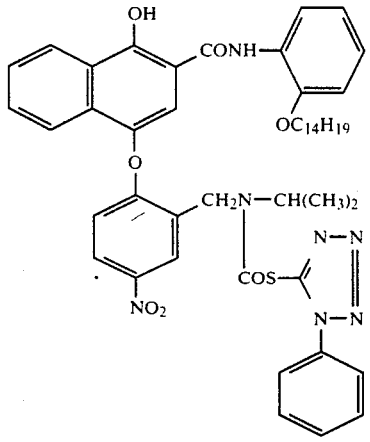
T-22
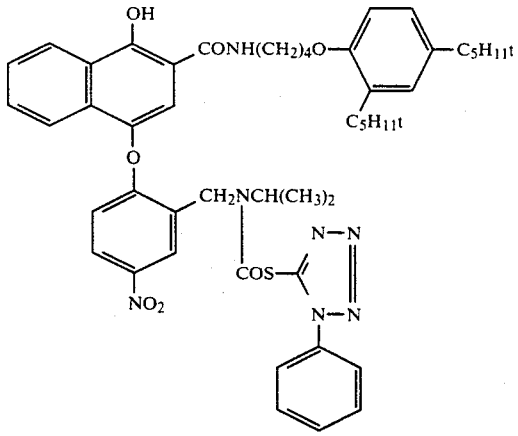
T-23 to T-30
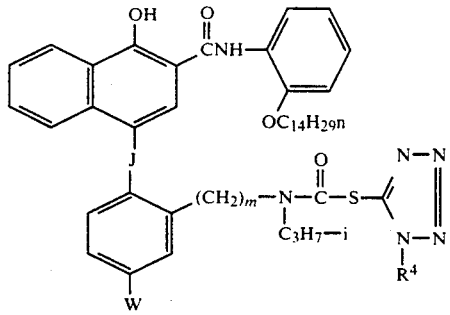
Wherein, J, W, m and $R^4$ represent respectively as follows:
| Compound No. | J | W | m | $R^4$ |
|---|---|---|---|---|
| T-23 | O | $NO_2$ | 0 | 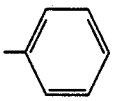 |
| T-24 | S | $NO_2$ | 1 | 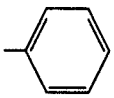 |

-continued
| | | | | |
|---|---|---|---|---|
| T-25 | O | $NO_2$ | 1 | 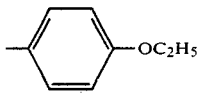 |
| T-26 | O | $NO_2$ | 1 | 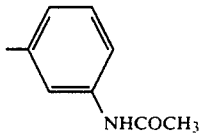 |
| T-27 | O | $NO_2$ | 1 | 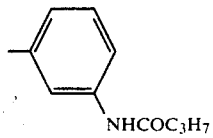 |
| T-28 | O | $NOSO_2C_4H_9$ | 0 | 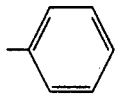 |
| T-29 | O | $NHSO_2C_8H_{17}$ | 1 | 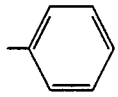 |
| T-30 | S | H | 0 | 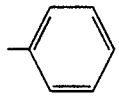 |
T-31 to T-35
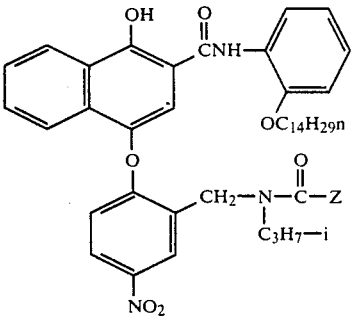
T-36
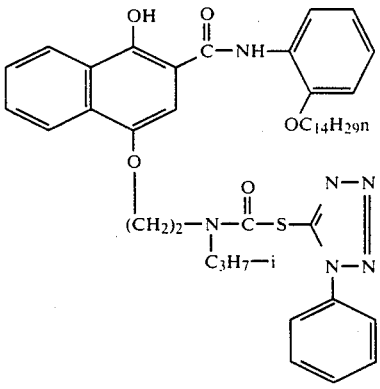
| Compound No. | Z |
|---|---|
| T-31 | Ethylmercaptotetrazol |
| T-32 | n-butylmercaptotetrazol |
| T-33 | Cyclohexylmercaptotetrazol |
| T-34 | N—heptylmercaptotetrazol |
| T-35 | 5,6-dichlorobenzotriazole |

-continued

T-37

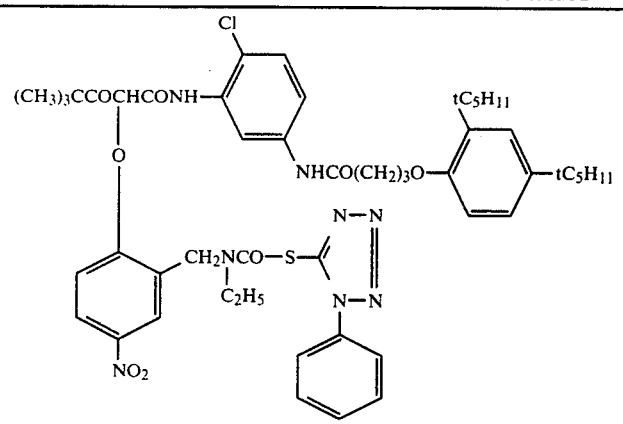

The DIR compounds to be preferably used in the invention are those shown in the aforesaid general formulae, (1) and (7), wherein Y radical is benzotriazole radical, particularly any radical shown in the general formula (e) or (f).

Either DIR compounds having timing radical or DIR compounds not having any timing radical can be used, or, the both thereof can jointly be used, as to the DIR compounds to be used in the invention.

And, in the case that an emulsion layer having some colorsensitivity comprising a plurality of layers having different sensitivity from each other, said DIR compounds can be contained in one or more layers thereof, and it is preferable that at least the lowest sensitive emulsion layer thereof contains said DIR compounds.

In the case of using either one of DIR compounds having timing radical or those not having any timing radical, or using the both compounds thereof in a color photosensitive material, the amount in the aggregate of said DIR compounds is preferably within the range of 0.0005 to 0.05 mols to one mol of silver halide in emulsions, particularly within the range of 0.001 to 0.01 mol thereto. The molar ratio of a mixture of said both compounds in the case of joint use thereof can be arbitrarily selected, however, it is preferable that the amount of DIR compounds having timing radicals is within the range of 0.02 to 50 mol % to the amount of DIR compounds not having any timing radical, particularly within the range of 0.1 to 5.0 mol thereto.

In color photosensitive materials relating to the invention, there can be used pyrazolone compounds, indazolone compounds and cyanoacetyl compounds as to anti-diffusive magenta couplers; phenol compounds and naphthol compounds as to anti-diffusive cyan couplers; and α-acylacetanilide compounds as to anti-diffusive yellow couplers.

Colored couplers can also be contained in any color photosensitive material of the invention.

The amount of anti-diffusive coupler to be used in the invention is normally $2\times10^{-3}$ mol to $5\times10^{-1}$ mol to every one mol of silver in a photosensitive silver halide emulsion layer, preferably $1\times10^{-2}$ mol to $5\times10^{-1}$ mol thereto.

The amount of colored couplers to be used in the invention is within the range of $1\times10^{-4}$ mol to $1\times10^{-1}$ mol to every one mol of silver in a photosensitive silver halide emulsion layer, preferably within the range of $5\times10^{-4}$ mol to $1\times10^{-2}$ mol thereto.

As for the diffusion processes for anti-diffusive couplers, a variety of the processes such as the so-called alkaline solution diffusing process, solid diffusion process, latex diffusion process and oil-in-water type emulsification diffusing process, can be used and suitably selected according to chemical composition of couplers, etc.

In the invention, latex diffusion process and oil-in-water type emulsification diffusing process are particularly effective. These processes have so far been well known, and latex diffusion process and the effects thereof have been described in the Japanese Patent Publication Open to Public Inspection Nos. 74538/1974, 59943/1976 and 32552/1979, and Research Disclosure, vol. 14850, pp. 77–79, August, 1976.

The suitable latexes are homopolymers, copolymers and terpolymers of monomers such as styrene, ethylacrylate, n-butylacrylate, n-butylmethacrylate, 2-acetoacetoxyethyl methacrylate, 2-(methacryloyloxy)ethyl trimethyl ammonium methosulfate, 3-(methacryloyloxy)propane-1-sodium sulfonate, N-isopropyl acrylamide, N-[2-(2-methyl-4-oxopentyl)]acrylamide and 2-acrylamide-2-methylpropane sulfonic acid. As for oil-in-water type diffusion processes, it is possible to apply so far publicly known processes wherein hydrophobic additives such as couplers are diffused. Couplers to be used in the invention can be diffused solely or jointly with the other couplers at the same time, and in the latter case said two kinds of couplers can also be diffused separately and then added independently.

Color photosensitive materials relating to the present invention will now be explained further in detail.

As for silver halide to be used in a silver halide emulsion layer of color photosensitive materials relating to the invention, there includes any arbitrary ones to be used in normal types of silver halide emulsion, such as silver chloride, silver bromide, silver iodide, silver chlorobromide, silver iodobromide and silver chloroiodobromide.

Silver halide grains thereof may be used whichever coarse grains or fine grains, and the distribution of grain diameter may be whichever localized or widely spread over. The crystals of said silver halide grains may be of normal or twin, and any arbitray ratio of [100] surface and [111] surface thereof may be used. Further, the structure of said silver halide grain crystal may be whichever the uniformed from the inside through the outside thereof or the layered structure wherein the inside and the outside are different in quality with each other side. And said silver halide may be whichever ones forming a latent image mainly on the surface thereof or in the grains thereof. Said silver halide grains can be prepared through the publicly known processes being commonly used in industries skilled in the art.

Silver halide emulsion to be used in the invention is prepferably used after soluble salts thereof were removed therefrom, however the ones not having removed said salts can also be used. And it is also possible to mixedly use two or more kinds of said silver halide emulsion which were prepared separately.

As for the binders for silver halide emulsion layers of color photosensitive materials of the invention, so far known binders are used, among those, there can be given as gelatin and the derivatives thereof such as phenylcarbamic substituted gelatin, acyl substituted gelatin and phthal substitued gelatin. Said binders can be used as two or more compatible mixtures as occasion demands.

Silver halide photographic emulsion, wherein the aforesaid silver halide grains were dispersed in binder solution thereof, can be sensitized by making use of chemical sensitizer. The chemical sensitizers capable of jointly using favorably in the invention, are classified roughly into four kinds thereof, viz., noble metal sensitizers, sulfuric sensitizers, selenium sensitizers and reduction sensitizers.

As for noble metal sensitizers, gold compounds and compounds of ruthenium, rhodium, palladium, iridium, platinum, etc. can be used.

And, when gold compounds are used, ammonium thiocyanate or sodium thiocyanate can be jointly used therewith.

As for sulfuric sensitizers, sulfuric compounds as well as active gelatin can be used.

As for selenium sensitizers, active and inactive compounds can be used.

As for reduction sensitizers, there are given as univalent tin salts, polyamine, bisalkylaminosulfide, silane compounds, iminoaminomethane sulfinic acid, hydrazinium salts and hydrazine derivatives.

Besides the aforesaid additives, a variety of other additives useful for photosensitive materials are used in color photosensitive materials of the invention, for example, stabilizers, development accelerators, emulsion hardeners, surface active agents, stain preventing agents, lubricants, ultraviolet-ray absorbing agents, etc.

In silver halide color photosensitive materials of the invention, auxiliary layers such as protective layer, interlayer, filter layer, anti-halation layer, backing layer, etc. can suitably be provided, besides silver halide emulsion layer.

As for supports, any so far known supports such as plastic film, plastic laminated paper, baryta paper, synthetic paper, etc. may suitably be chosen according to the purpose for using photosensitive materials. Normally, said support is provided with subbing layer to strengthen the adhesion thereof to a photographic emulsion layer.

Color photographic sensitive materials of the invention can form an image thereon through the use of a color development process which is commonly used, after an exposure to light.

The fundamental processing steps through negative-positive process include color development step and bleach-fix step therein. There are sometimes the cases that each fundamental processing step is taken independently, and there are also the cases that a single process can be made by making use of a solution wherein those of the above function are integrated therein. For example, they are given as monobath color development processes wherein color developing agent, ferric salt bleaching component and thiosulfate fixing component are used, or monobath bleach-fix process wherein ethylenediamine tetrairon (III) acetate complex salt bleaching component are used.

There is no particular limitation to the processes for color photosensitive materials of the invention, and any of the processes are applicable for. For the exemplary examples, a process wherein a color development is made and then a bleach-fix is processed and if necessary washing and stabilizing process are further taken; a process, wherein a color development is made, and then a bleaching and fixing are made separately, and if necessary, washing and stabilizing processes are taken; a process, wherein prehardening, neutralization, color development, stop-fixing, washing, bleaching, fixing, washing, posthardening, and washing are made in successive order; a process, wherein color development, washing, supplemental color development, stopping, bleaching, fixing, washing and stabilizing in successive order; a process, wherein a halogenation bleach is processed on developed silver which was produced by a color development, and then another color development process is applied again and thus the amount of dyes to be produced is increased thereby; or a process, wherein a photosensitive material having a small amount of silver is processed by making use of amplifier such as peroxide or cobalt complex salt; any of which can be used for processing color photosensitive material of the invention.

As for aromatic primary amine color developing agents, a series of p-phenylene diamine and a series of p-aminophenol can be given as the examples thereof, and the former is the exemplified. And the process can be done by adding color developing agent into a color photosensitive material.

As for the precursors of color developing agent to be used in the invention, Schiff base type color developers described in the U.S. Pat. Nos. 2,507,114, 2,695,234 and 3,342,599, and Research Disclosure, vol. 151, No. 15159, November 1979 issue, and the precursors described in Research Disclosure, vol. 129, No. 12924, October 1976 issue, Ibid., vol. 121, No. 12146, June 1974 issue, and Ibid., vol. 139, No. 13924, November 1975 issue, can be applied to use for. And, a variety of additives can be added into color development solution as occasion demands.

By utilizing a color photosensitive material of the invention and by printing on a color printing paper having the following composition, a color image can be formed thereby.

Color printing paper:

A color printing paper having red-photosensitive silver halide emulsion layer having been contained with anti-diffusive cyan couplers, green-photosensitive silver halide emulsion layer having been contained with anti-diffusive yellow couplers and blue-photosensitive silver halide emulsion layer having been contained with anti-diffusive magenta couplers, on the support thereof.

As for the materials, additives, etc. to be used in said color printing paper, any matter which have so far been known one for color printing paper use is used.

While the examples of the present invention will be described hereafter it is to be understood that the invention shall not be limited thereto.

EXAMPLE 1

Preparation of sample 1

Sample 1 has been prepared, wherein the following layers were coated in successive order onto a support comprising subbing layered cellulose triacetate film.

Layer-1 . . . Anti-halation layer

Black colloidal silver was dispersed in gelatin solution and with which coating was made so that the dry thickness of the layer can be 2.0μ at the ratio of 0.4 g/m$^2$ of silver to 3 g/m$^2$ of gelatin.

Layer-2 . . . Red-photosensitive high speed silver halide emulsion layer

Red-photosensitive high speed silver iodobromide emulsion layer (whose average grain diameter is 1.2 μ in size) containing 7 mol% of silver iodide was prepared in a usual process. Having added with 0.25 g of 4-hydroxy-6-methyl-1,3,3*a*,7-tetrazaindene and 7.5 mg of 1-phenyl-5-mercaptotetrazole and further added with 250 ml of dispersed matter (C-1) and coating has been done so that the dry thickness can be 4.5μ.

Layer-3 . . . Interlayer

Coating has been done so that the dry thickness can be 0.7μ at the ratio of 1.2 g/m$^2$ of gelatin, wherein non-photosensitive silver iodobromide grains having been contained 4 mol% of silver iodide whose average grain diameter is 0.2μ and every 1.5 g of polyvinyl pyrolidone to one mol of silver halide, 0.07 g/m$^2$ of 2,5-di-t-octyl hydroquinone and 5 mg/m$^2$ of silver.

Layer-4 . . . Green-photosensitive high speed silver halide emulsion layer

Green-photosensitive high speed silver iodobromide emulsion layer (of which the average grain diameter is 1.2μ) containing 7 mol% of silver iodide has been prepared in a usual process. Into thus prepared emulsion, 0.25 g of 4-hydroxy-6-methyl-1,3,3*a*,7-tetrazaindene and 5 mg of 1-phenyl-5-mercaptotetrazole were added therein. Then, 250 ml of dispersed matter (M-1) was added therein and coating was made so that the dry thickness can be 4.5μ.

Layer-5 . . . Interlayer

Coating was made with gelatin solution so that the dry thickness can be 10μ.

Layer-6 . . . Yellow filter layer

Having dissolved 3 g of 2,5-di-t-octyl hydroquinone and 1.5 g of di-2-ethylhexyl phthalate with 10 ml of ethyl acetate and dispersed in 50 ml of 10% gelatin solution containing 0.3 g of sodium triisopropyl naphthalene sulfonate, thus prepared dispersed solution was added into gelatin solution wherein yellow colloidal silver was dispersed, and coating was made with thus obtained solution at the ratio of 0.9 g/m$^2$ of gelatin, 0.07 g/m$^2$ of 2,5-di-t-octyl hydroquinone so that the dry thickness can be 1.2μ.

Layer-7 . . . Blue-photosensitive high speed silver halide emulsion layer

Blue-photosensitive high speed silver iodobromide emulsion layer (of which the average grain diameter is 1.2μ in size) containing 7 mol% of silver iodide was prepared in a normal process. In this emulsion, 0.25 g of 4-hydroxy-6-methyl-1,3, 3*a*,7-tetrazaindene and 5 mg of 1-phenyl-5-mercaptotetrazole were added. Next, 350 ml of dispersed matter (Y-1) and 4 g of 1,2-bisvinylsulfonyl ethane were added therein, and then coating was made so that the dry thickness can be 7.0μ.

Layer-8 . . . Protective layer

With gelatin solution containing 4 g of gelatin and 0.2 g of 1,2-bisvinylsulfonyl ethane per 100 ml of the solution, coating was made at the ratio of 1.3 g/m$^2$ so that the dry thickness of 1.2μ.

Also, the dispersed matters having been used in each of the layers were prepared as follows:

Dispersed matter (C-1)

Non-diffusive cyan couplers, (C-1), in the amount of 50 g and 4 g of colored cyan couplers (CC-1), were heatedly dissolved in a mixture of 55 g of tricresyl phosphate, (hereinafter referred to as TCP), and 110 ml of ethyl acetate, (hereinafter referred to as EA), and thus obtained solution was added into 400 ml of 7.5% of gelatin solution containing 4 g of sodium triisopropyl naphthalene sulfonate, and then emulsifiedly dispersed by making use of a colloid mill, and thus, the dispersed matter has been prepared in the amount of 1000 ml.

Dispersed matter (M-1)

Non-diffusive magenta coupler, (M-1), in the amount of 45 g, 18 g of (M-2) and 14 g of colored magenta coupler were dissolved in a mixture of 77 g of TCP and 280 ml of EA and thus obtained solution was added into 500 ml of 7.5% gelatin solution containing 8 g of sodium triisopropyl naphthalene sulfonate and then emulsifiedly dispersed by making use of a colloid mill, and thus the dispersed matter has been prepared in the amount of 1000 ml.

Dispersed matter (Y-1)

Non-diffusive yellow couplers (Y-1) in the amount of 300 g were heatedly dissolved in a mixture of 150 g of dibutyl phthalate, (hereinafter referred to as DBP), and 500 ml of EA, and thus obtained solution was added into 1600 ml of 7.5% of gelatin (solution) containing 18 g of sodium triisopropyl naphthalene sulfonate and emulsifiedly dispersed by making use of a colloid mill, and thus, the dispersed matter has been prepared in the amount of 2500 ml.

Coupler:

C-1

1-hydroxy-4-(β-methoxyethylaminocarbonylmethoxy)-N-[δ-(2,4-di-tert-amylphenoxy) butyl]-2-naphthamide.

CC-1

1-hydroxy-4-[4-(1-hydroxy-8-acetamide-3,6-disulfo-2-naphthylazo)phenoxy]-N-[δ-(2,4-di-t-amylphenoxy)-butyl]-2-naphthamide disodium salt.

M-1

1-(2,4,6-trichlorophenyl)-3-[3-(2,4-di-t-amylphenoxy acetamide)benzamide]-5-pyrazolone

M-2

4,4'-methylenebis{1-(2,4,6-trichlorophenyl)-3-[3-(2,4-di-t-amylphenoxy acetamide)benzamide]-5-pyrazolone}

CM-1

1-(2,4,6-trichlorophenyl)-4-(1-naphthylazo)-3-(2-chloro-5-octadecenylsuccinimideanilino)-5-pyrazolone.

Y - 1

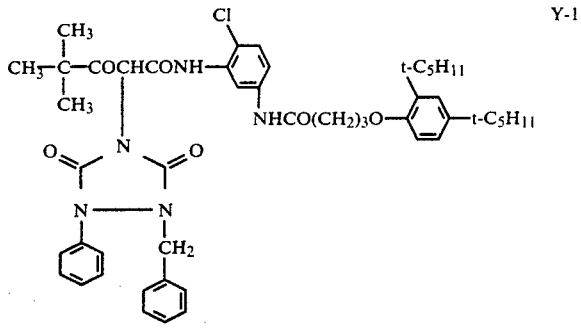

Preparation of sample 2

The dispersed matter (M-2) has been prepared through the similar process having been applied to prepare the dispersed matter (M-1), except that 0.2 g of DIR compound, D-64, was added further into the same kind of dispersed matter, (M-1), which has been used in the layer-4 of sample 1. And, sample 2 has been prepared through the similar process to that for preparing sample 1, except that 300 ml of thus prepared dispersed matter, (M-2), was added into the layer 4.

Preparation of sample 3

The following each layer has been coated in successive order onto a support comprising subbing layered polyethyleneterephthalate film:

Layer-1 . . . Antihalation layer

The same as the layer-1 of sample 1.

Layer-2 . . . Red-photosensitive high speed silver halide emulsion layer

The same as the layer-2 of sample 1.

Layer-3 . . . Interlayer

The same as the layer-3 of sample 1.

Layer-4 . . . Green-photosensitive high speed silver halide emulsion layer

Green-photosensitive high speed silver iodobromide emulsion containing 7 mol% of silver iodide (wherein, the average grain diameter is 1.05μ in size, and every 0.25 mol of silver halide and 40 g of gelatin are contained per one kg whereof), has been prepared through a normal process. Into thus prepared emulsion, 0.25 g of 4-hydroxy-6-methyl-1,3,3*a*,7-tetrazaindene and 5 mg of 1-phenyl-5-mercaptotetrazol were added. Next, 350 ml of dispersed matter, (Y-1), were added therein and the coating was then made onto a support so that the dry thickness can be 4.5μ.

Layer-5 . . . Interlayer

The same as the layer-5 of sample 1.

Layer-6 . . . Yellow filter layer

The same as the layer-6 of sample 1.

Layer-7 . . . Blue-photosensitive high speed silver halide emulsion layer

Blue-photosensitive high speed silver iodobromide emulsion containing 7 mol% of silver iodide (whose average grain diameter is 1.2μ in size) was prepared through a normal process. Into thus prepared emulsion, 0.25 g of 4-hydroxy-6-methyl-1,3,3*a*,7-tetrazaindene and 5 mg of 1-phenyl-5-mercaptotetrazole were added. Next, 250 ml of dispersed matter, (M-1), and 4 g of 1,2-bisvinylsulfonyl ethane were added therein and the coating was made onto a support so that the dry thickness can be 7.0μ.

Layer-8 . . . Protective layer

The same as the layer-8 of sample 1.

Preparation of sample 4

The dispersed matter, (Y-2), has been prepared through the similar process to that in sample 3, except that 0.29 g of DIR compound, D-64, was further added into dispersed matter, (Y-1), which was used in the layer-4 of sample 3. And sample 4 has been prepared through the similar process to that in sample 3, except that 380 ml of thus prepared dispersed matter, (Y-2), were added into the layer 4.

Preparation of sample 5

The dispersed matter, (Y-3), was prepared through the similar process to that in sample 3, except that 0.55 g of DIR compound, T-37, was further added into dispersed matter, (Y-1), which was used in the layer-4 of sample 3. And sample 5 has then been prepared through the similar process to that in sample 3, except that 380 ml of thus prepared dispersed matter, (Y-3), were added into the layer-4.

The inter-image effect from green-photosensitive layer to blue-photosensitive layer has been inspected, wherein each sample was exposed to green light through an optical wedge, and then uniform exposure to blue-light only was made onto samples 1 and 2 respectively so that their yellow color density can be at 2.0 and onto samples 3, 4 and 5 respectively so that their magenta density can be at 2.0, and thereafter color development was performed following the processing steps as mentioned below. Also, the relative sensitivity ratio and gamma of each sample has been inspected, wherein each sample was exposed to white-light through an optical wedge and then the similar process to the aforesaid was performed. The results thereof are shown in Table 1.

| Process (at 38° C.) | Time |
|---|---|
| Color development | 3'15" |
| Bleaching | 6'30" |
| Washing | 3'15" |
| Fixing | 6'30" |
| Washing | 3'15" |
| Stabilizing | 1'30" |

The following is the composition of the processing solution used in each processing step: Composition of color developing solution:

| | | |
|---|---|---|
| 4-amino-3-methyl-N—ethyl-N(β-hydroxyethyl)-aniline sulfate | 4.8 | g |
| Sodium sulfite anhydrous | 0.14 | g |
| Hydroxyamine.½ sulfate | 1.98 | g |
| Sulfuric acid | 0.74 | g |
| Potassium carbonate anhydrous | 28.85 | g |
| Potassium hydrogencarbonate anhydrous | 3.46 | g |
| Potassium bromide | 1.16 | g |
| Sodium chloride | 0.14 | g |
| Nitrilotriacetic acid.3 sodium salt (monohydrate) | 1.20 | g |
| Potassium hydroxide | 1.48 | g |
| Add water to make | 1 | l |
| Composition of bleaching solution: | | |
| Ethylenediamine-tetraacetic acid ammonium ferric salt | 100.0 | g |
| Ethylenediamine-tetraacetic acid 2-ammonium salt | 10.0 | g |
| Ammonium bromide | 150.0 | g |
| Glacial acetic acid | 10.0 | ml |
| Add water to make 1 l and adjust the pH value at | | |

-continued

| | | |
|---|---|---|
| pH 6.0 by making use of aqueous ammonia. | | |
| Composition of fixing solution: | | |
| Ammonium thiosulfate | 175.0 | g |
| Sodium sulfite, anhydrous | 8.6 | g |
| Sodium metasulfite | 2.3 | g |
| Add water to make 1 l and adjust the pH value at pH 6.0 by making use of acetic acid. | | |
| Composition of stabilizing solution: | | |
| Formalin (37% solution) | 1.5 | ml |
| Konidux (mfd. by Konishiroku Photo Ind. Co., Ltd.) | 7.5 | ml |
| Add water to make | 1 | l |

Next, with respect to color images formed on samples and the comparison samples, the relative sensitivity ratio and gamma thereof were measured. The results thereof are shown in Table 1.

Also, in the table, the ratios of photographic fog and sensitivity of each unit layer forming color images indicate the values measured when the exposures were made to white-light, wherein, the fog value is that deducted the value of mask density from the minimum density value of each unit layer, and the sensitivity ratio expresses in value relative to the sensitivity of green-photosensitive unit layer of sample 1 having been given an exposure to white-light is taken as 100.

TABLE 1

| | Green-photosensitive layer | | Blue-photosensitive layer | | |
|---|---|---|---|---|---|
| | Relative sensitivity | Gamma | Relative sensitivity | Gamma | ΔD |
| 1 Other than the invention | 100 | 0.55 | 100 | 0.68 | 0.05 |
| 2 Other than the invention | 100 | 0.54 | 100 | 0.67 | 0.10 |
| 3 Other than the invention | 110 | 0.56 | 100 | 0.68 | 0.09 |
| 4 The invention | 100 | 0.54 | 100 | 0.68 | 0.30 |
| 5 The invention | 100 | 0.54 | 100 | 0.67 | 0.38 |

Note

1: Relative sensitivity expresses as that the each sensitivity of Fog + 0.1 of green-photosensitive layer and blue-photosensitive layer of sample 1, is taken as 100.

2: Gamma expresses the inclination of the characteristics curve of Δlog E = 1.0 from the point of Fog + 0.1.

3: ΔD expresses the inter-image effect from green-photosensitive layer to blue-photosensitive layer and the more the value of ΔD increased, the higher the I.I.E and the purity of blue-color are improved.

ΔD = (2.0 - D1)/2.0 wherein, D represents a color density of blue-photosensitive layer when a color density of green-photosensitive layer is at a maximum.

As is obvious from Table 1, it can be recognized that samples 4 and 5 of the present invention can improve the interimage effects from green-photosensitive layer to blue-photosensitive layer and the purity of blue-color remarkably higher, compared with the other samples than those of the present invention.

What is claimed is:

1. A multi-layered color photosensitive material comprising a support, and a red-photosensitive silver halide emulsion layer containing a nondiffusion cyan coupler, a green-photosensitive silver halide emulsion layer containing nondiffusion yellow coupler and a blue-photosensitive silver halide emulsion layer containing a nondiffusion magenta coupler provided in this order on the support, said green-photosensitive silver halide emulsion layer comprising a compound which is capable of releasing a development inhibiting substance by reacting with an oxidized color developing agent.

2. A multi-layered color photosensitive material according to claim 1, the compound is represented by the following general formula (1):

$$A - TIME - Z \qquad (1)$$

wherein A represents an ingredient which is, upon reaction with an oxidized color developing agent, capable of releasing TIME-Z radical therefrom, Z represents a development inhibiting ingredient, and TIME represent a timing radical which is capable of releasing Z subsequent to releasing of TIME-Z radical from A.

3. A multi-layered color photosensitive material according to claim 2, the compound is represented by the following general formula (2):

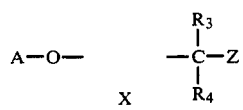

(2)

wherein A represents an ingredient being capable of reacting with an oxidized color developing agent, X represents a substituted or unsubstituted benzene ring or a substituted or unsubstituted naphthalene ring, $R^3$ and $R^4$ independently represent hydrogen atom, an alkyl radical or an aryl radical provided that the radical

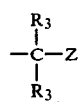

is substituted at orthoposition or para-position with respect to oxygen atom of formula.

4. A multi-layered color photosensitive material according to claim 2, the compound is represented by the following general formula (6):

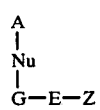

(6)

wherein A represents an ingredient being capable of reacting with an oxidized color developing agent, Nu represents oxygen, sulfur or nitrogen atom, G represents a radical capable of stracturally connecting Nu with E, E represents an electrophilic radical comprising carbonyl radical, thiocarbonyl radical, phosphinyl radical or thiophosphinyl radical, and Z represents a development inhibiting ingredient, provided that said -Nu-G-E-Z radical is one capable of causing, subsequent to release from A, intramolecular nucleophilic substitution reaction to form a 3 to 7 membered ring, thereby releasing Z therefrom.

5. A multi-layered color photosensitive material according to claim 3 or 4, wherein Z is represented by the following general formulas (a) to (f):

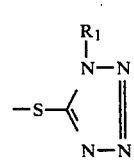

(a)

-continued (b)

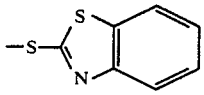

(c)

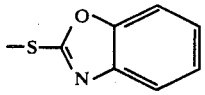

(d)

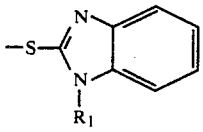

(e)

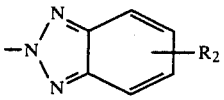

-continued (f)

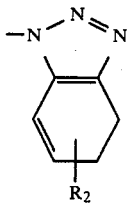

wherein $R_1$ represents hydrogen atom, an alkyl radical having one to eight carbon atoms, phenyl radical or a substituted phenyl radical and $R_2$ represents hydrogen or halogen atom, a lower alkyl radical having one to four carbon atoms or nitro radical.

6. A multi-layered color photosensitive material according to claim 1, the chemical compound is represented by the following general formula (7):

$$A—Z \qquad (7)$$

wherein A represents an ingredient being capable of reacting with an oxidized color developing agent and Z represents a development inhibiting ingredient.

* * * * *